US006253923B1

(12) United States Patent
Felkins

(10) Patent No.: US 6,253,923 B1
(45) Date of Patent: Jul. 3, 2001

(54) APPARATUS FOR SEPARATING TRASH FROM LINT COTTON

(76) Inventor: Roger C. Felkins, 15156 County Rd. 400, Hillsboro, AL (US) 35643

( * ) Notice: Subject to any disclaimer, the term of this patent is extended or adjusted under 35 U.S.C. 154(b) by 0 days.

(21) Appl. No.: 09/458,762

(22) Filed: Oct. 1, 1999

(51) Int. Cl.[7] ..... B07B 7/00
(52) U.S. Cl. ..... 209/137; 209/142; 19/303
(58) Field of Search ..... 209/20, 133, 136, 209/137, 142, 143; 19/303

(56) References Cited

U.S. PATENT DOCUMENTS

| | | | | |
|---|---|---|---|---|
| 2,366,705 | * | 1/1945 | Berry | 209/137 |
| 2,681,476 | | 6/1954 | Van Doorn | 209/137 |
| 2,681,477 | | 6/1954 | Van Doorn | 209/137 |
| 5,437,373 | * | 8/1995 | Desmadryl | 209/137 |
| 6,089,378 | * | 7/2000 | Mascheretti et al. | 209/143 |

* cited by examiner

*Primary Examiner*—Tuan N. Nguyen

(74) *Attorney, Agent, or Firm*—Walker, McKenzie & Walker, P.C.

(57) ABSTRACT

An apparatus including ductwork with an inlet duct having an inlet port for receiving a cotton/trash mix discharged by a cotton gin, a lint cotton outlet duct having a lint cotton outlet port for allowing lint cotton to exit therethrough, and a trash outlet port intermediate the inlet port of the inlet duct and the lint cotton outlet port of the lint cotton outlet duct for allowing trash to exit therethrough; the inlet duct having an interior passageway, at least a portion of the interior passageway of the inlet duct having a contour with a variable cross-sectional area; the lint cotton outlet duct having an interior passageway, at least a portion of the interior passageway of the lint cotton outlet duct having a contour with a variable cross-sectional area. The apparatus further includes a knife positioned at the trash outlet port; and a control mechanism for causing movement of at least a portion of the inlet duct to vary the cross sectional area of the contour of at least a portion of the interior passageway thereof and/or the size of the trash outlet port, and for causing movement of at least a portion of the lint cotton outlet duct to vary the cross sectional area of the contour of at least a portion of the interior passageway thereof and for causing movement of the knife to vary the size of the trash outlet port.

1 Claim, 6 Drawing Sheets

APPARATUS FOR SEPARATING TRASH FROM LINT COTTON

CROSS-REFERENCE TO RELATED APPLICATIONS

Not Applicable.

STATEMENT RE FEDERALLY SPONSORED RESEARCH OR DEVELOPMENT

Not Applicable.

REFERENCE TO A "MICROFICHE APPENDIX"

Not Applicable.

BACKGROUND OF THE INVENTION

1. Field of the Invention

The present invention relates, in general, to an apparatus for separating trash and lint cotton in a cotton/trash mix discharged from a cotton gin or the like.

2. Information Disclosure Statement

A preliminary patentability search conducted in class 209, subclass 137, and class 19, subclasses 39, 303, 203, 204 and 205, produced the following patents which appear to be relevant to the present invention:

Van Doorn, U.S. Pat. No. 2,681,476, issued Jun. 22, 1954, and Van Doom, U.S. Pat. No. 2,681,477, issued Jun. 22, 1954, disclose apparatuses for placement between a gin stand or the like and a common lint flue to separate lint cotton and trash from an air-borne stream passing from a gin stand. Each apparatus has ductwork including, in general, a inlet duct for receiving the air-borne stream of lint cotton and trash from the gin stand, a lint outlet duct angularly disposed with respect to and communicating with the inlet duct for conveying lint from the air-borne stream to the common lint flue, and a trash outlet opening at the junction between the inlet duct and the lint outlet duct, the trash outlet opening having a sharp edge on the upstream side thereof for stripping trash from the air-borne stream and serving as a divider so that the trash will pass out of the ductwork through the trash outlet opening.

The typical air cleaner used to clean lint cotton as the lint cotton is discharged from a cotton gin is designed to remove trash or separate trash from lint using centrifugal force. Cotton is lighter that some trash. Some of the previous cleaners made around the 1950's, such as those disclosed in the above-identified Van Doorn patents, are still the standard with larger units means up to 9 feet (2.74 meters) wide and up to 6 feet (1.83 meters) deep.

Nothing in the known prior art discloses or suggests the present invention. More specifically, nothing in the known prior art discloses or suggests an apparatus including an inlet duct having an inlet port for receiving a cotton/trash mix discharged by a cotton gin, including a lint cotton outlet duct having a lint cotton outlet port for allowing lint cotton to exit therethrough, and having a trash outlet port intermediate the inlet port of the inlet duct and the lint cotton outlet port of the lint cotton outlet duct for allowing trash to exit therethrough; a knife positioned at the trash outlet port; and control means for causing movement of at least a portion of the inlet duct to vary the cross sectional area of the contour of at least a portion of the interior passageway thereof and/or the size of the trash outlet port, and for causing movement of at least a portion of the lint cotton outlet duct to vary the cross sectional area of the contour of at least a portion of the interior passageway thereof and for causing movement of the knife to vary the size of the trash outlet port.

BRIEF SUMMARY OF THE INVENTION

The present invention provides an apparatus for cleaning lint cotton as the lint cotton is discharged from a cotton gin. A basic concept of the present invention is to provide such a cleaning apparatus that has multiple adjustments to vary the flow of the cotton—trash mix therethrough.

The apparatus of the present invention comprises, in general, ductwork including an inlet duct having an inlet port for receiving the cotton/trash mix discharged by the cotton gin, including a lint cotton outlet duct having a lint cotton outlet port for allowing lint cotton to exit therethrough, and having a trash outlet port intermediate the inlet port of the inlet duct and the lint cotton outlet port of the lint cotton outlet duct for allowing trash to exit therethrough; the inlet duct having an interior passageway, at least a portion of the interior passageway of the inlet duct having a contour with a variable cross-sectional area; the lint cotton outlet duct having an interior passageway, at least a portion of the interior passageway of the lint cotton outlet duct having a contour with a variable cross-sectional area; a knife positioned at the trash outlet port; and control means for causing movement of at least a portion of the inlet duct to vary the cross sectional area of the contour of at least a portion of the interior passageway thereof and/or the size of the trash outlet port, and for causing movement of at least a portion of the lint cotton outlet duct to vary the cross sectional area of the contour of at least a portion of the interior passageway thereof and for causing movement of the knife to vary the size of the trash outlet port.

One object of the present invention is to provide a small, light and compact cleaner that can be placed in the ductwork of an existing gin with little modification.

Another object of the present invention is to provide a cleaner with the ability to adjust the entire elbow in and out.

Another object of the present invention is to provide a cleaner with a knife blade positioned in the air-stream about center distance of the elbow between the inlet duct and lint cotton outlet duct.

Another object of the present invention is to provide an adjustment of the ductwork directly in front of the elbow to allow the air stream to be placed in line with the knife blade or narrow the air stream if desired.

Another object of the present invention is to provide a cleaner with adjustment to move into the knife blade and close off the elbow system.

Another object of the present invention is to provide a cleaner with three arms for manual adjustment located at each end of the cleaner.

DETAILED DESCRIPTION OF THE INVENTION

Figure 1:
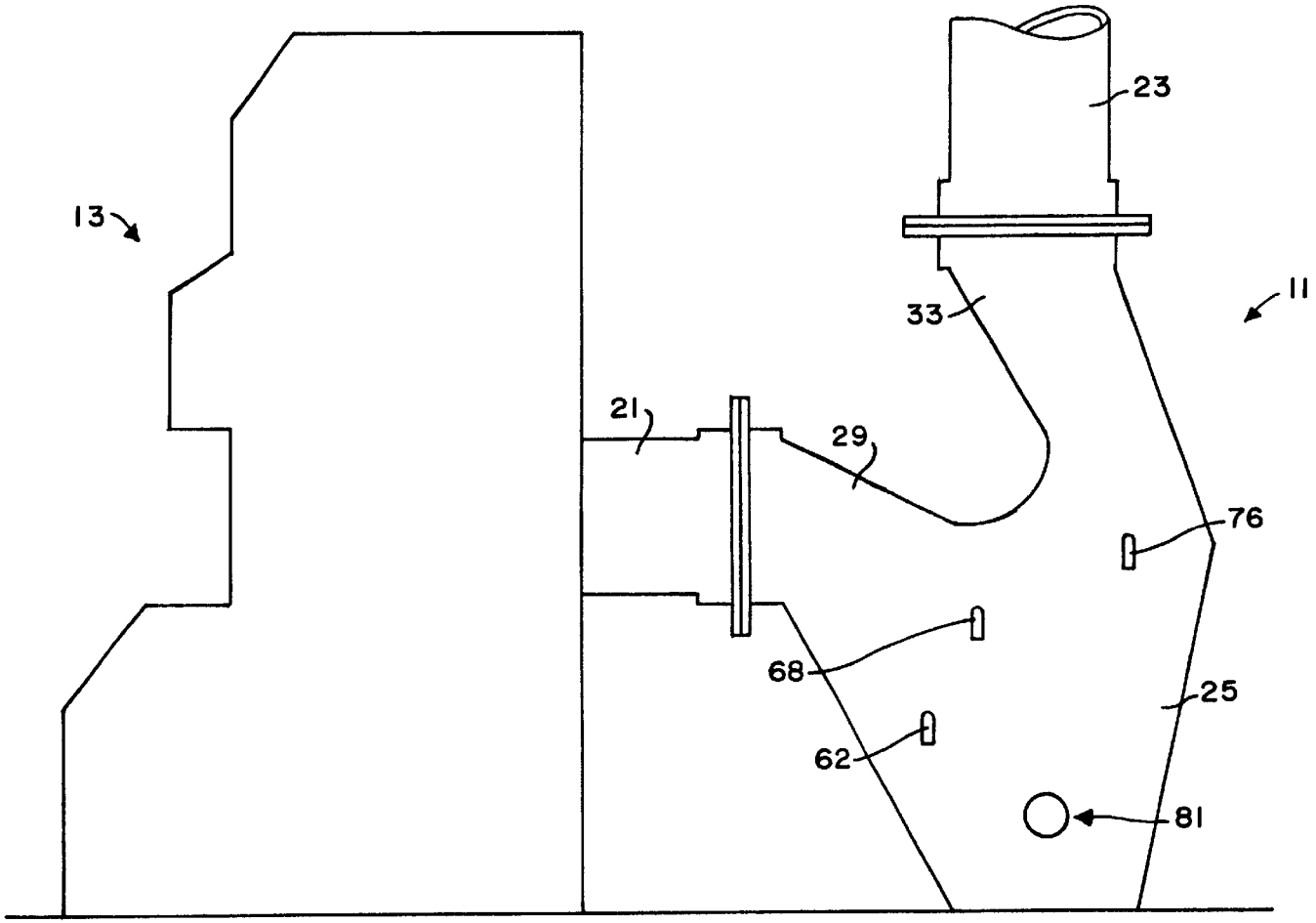
FIG. 1 is a somewhat diagrammatic side elevational view of the apparatus of the present invention shown in combination with a cotton gin.
Figure 2:
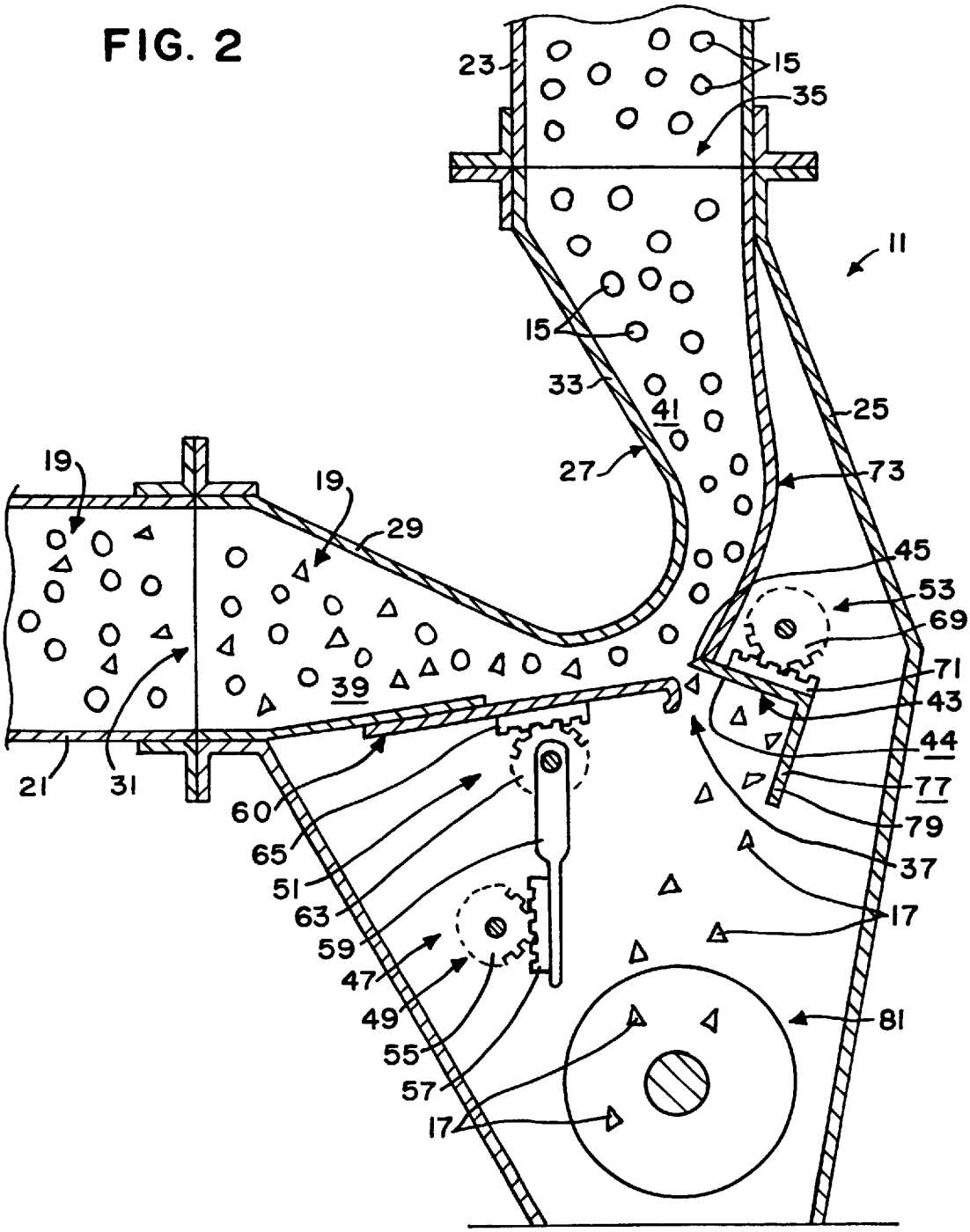
FIG. 2 is a somewhat diagrammatic sectional view of the apparatus of the present invention.
Figure 3:
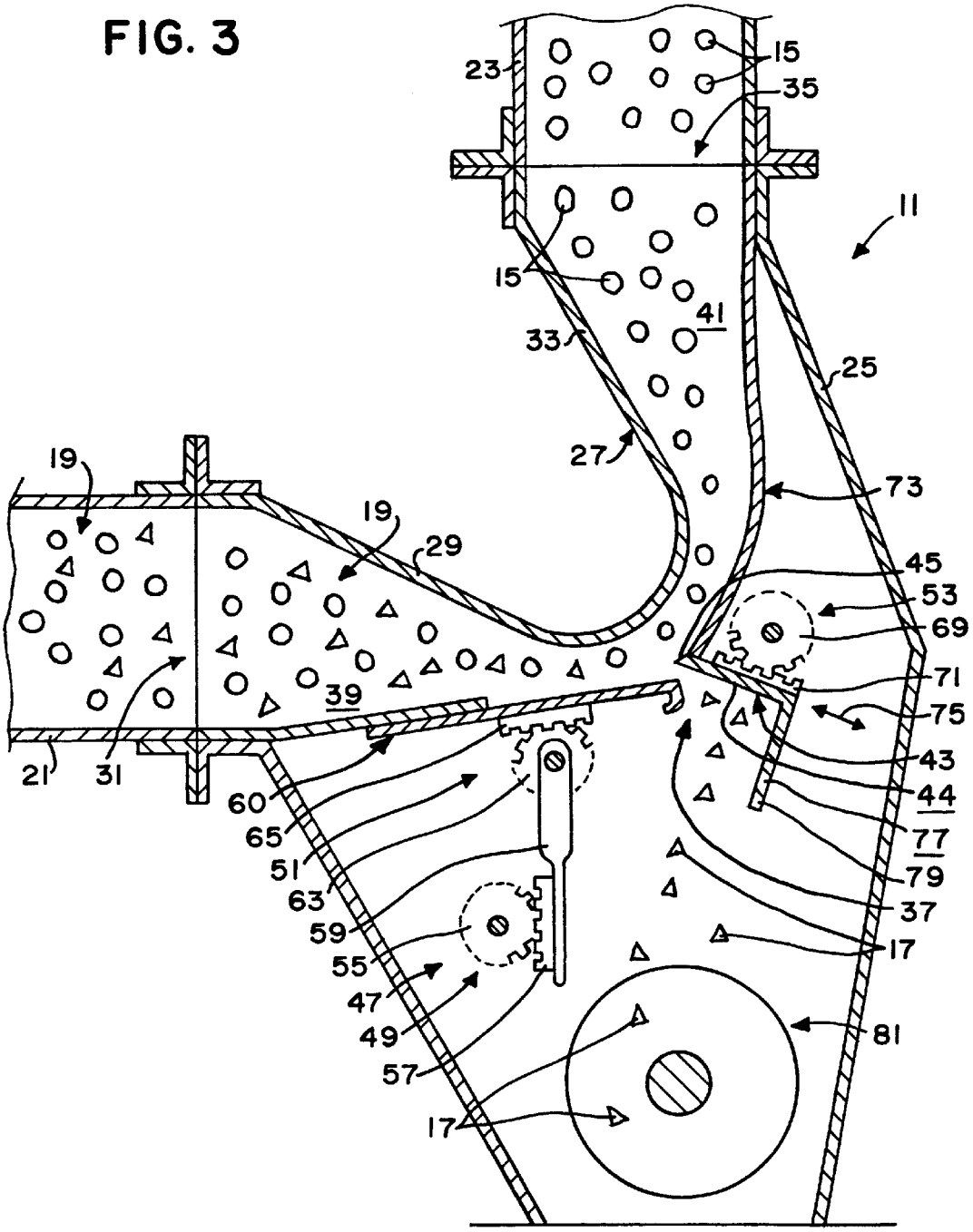
FIG. 3 is a sectional view similar to FIG. 2 but with portions of the apparatus in a moved position.
Figure 4:
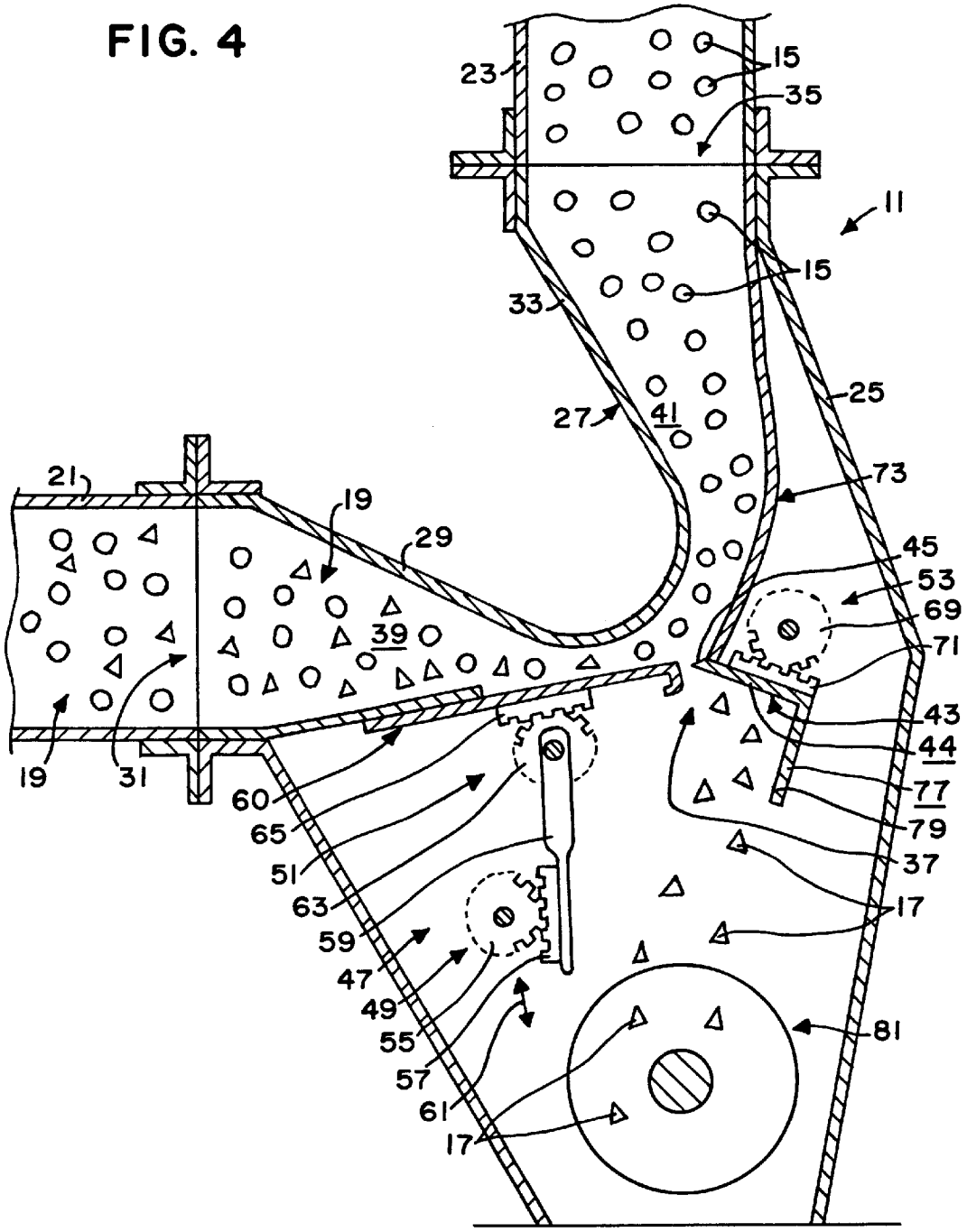
FIG. 4 is a sectional view similar to FIGS. 2 and 3 but with portions of the apparatus in a moved position.
Figure 5:
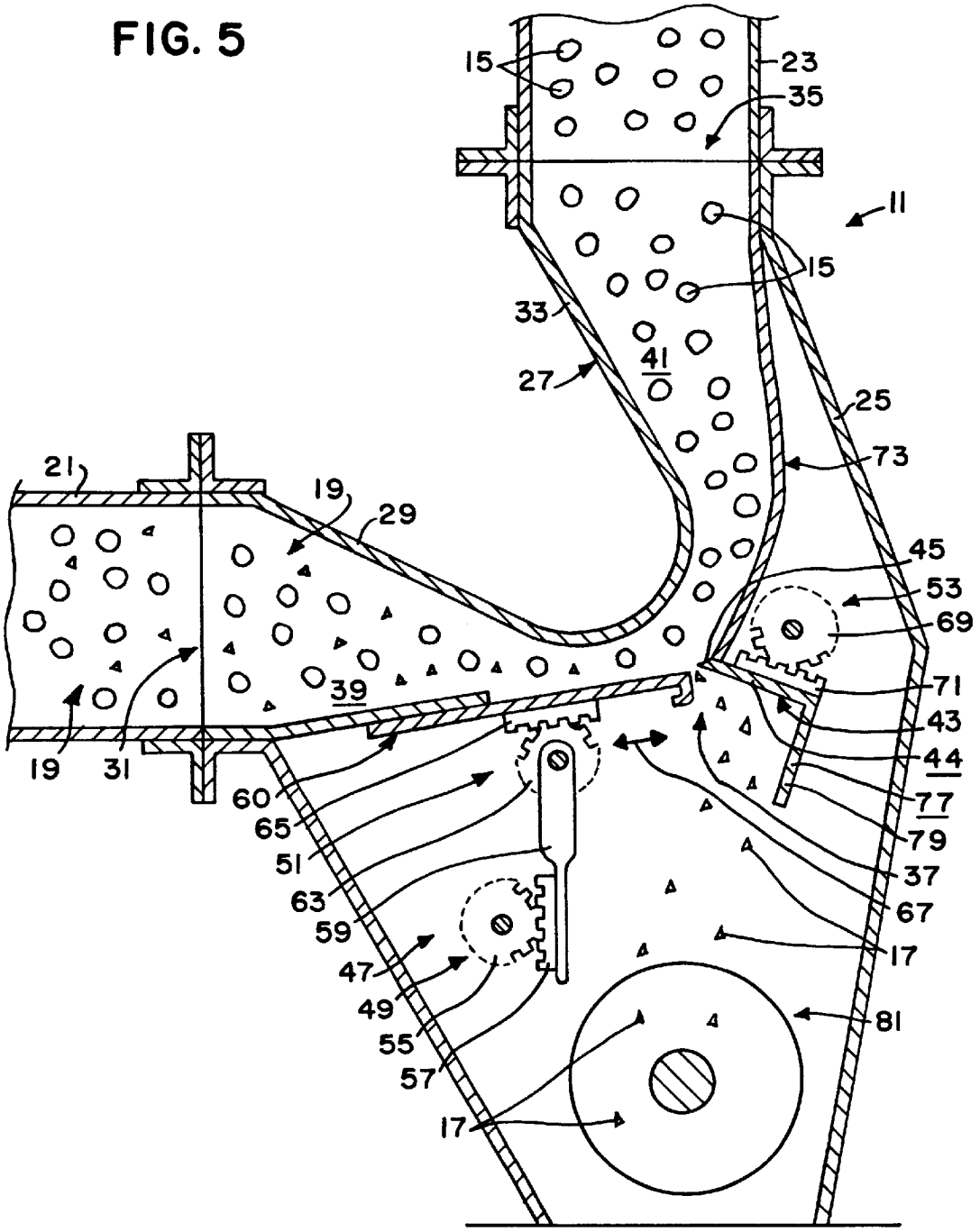
FIG. 5 is a sectional view similar to FIGS. 2, 3 and 4 but with portions of the apparatus in a moved position.
Figure 6:
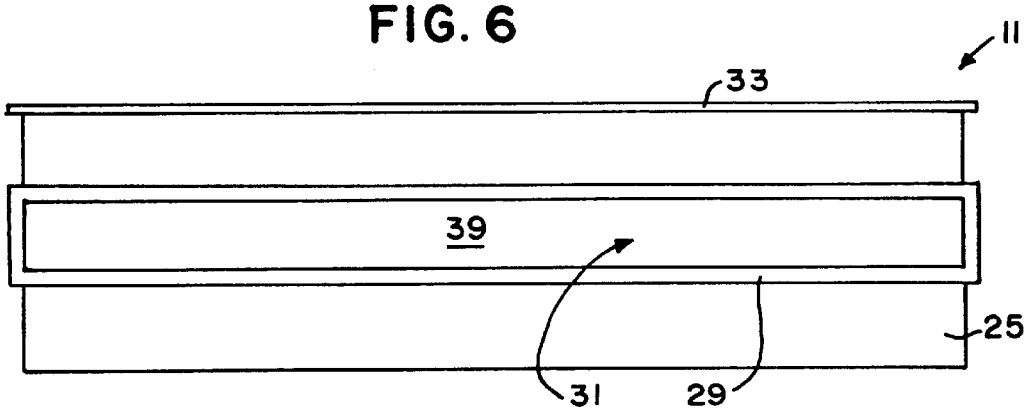
FIG. 6 is a somewhat diagrammatic front elevational view of the apparatus of the present invention.
Figure 7:
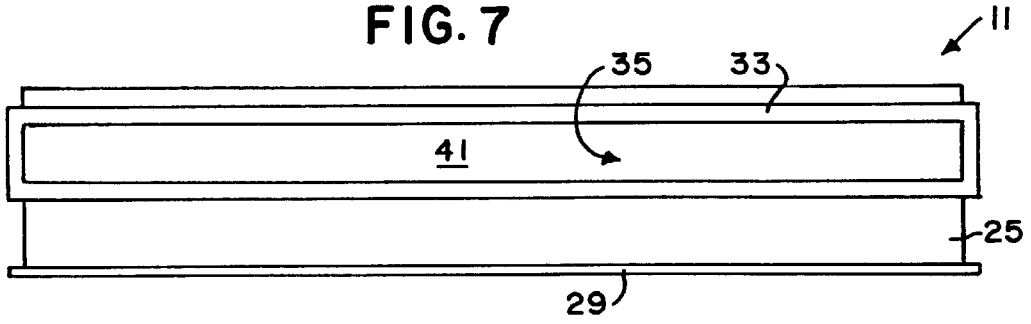
FIG. 7 is a somewhat diagrammatic top plan view of the apparatus of the present invention.

A preferred embodiment of the apparatus of the present invention is shown in FIGS. 1–7, and identified by the numeral 11. The apparatus 11 is for use with a cotton gin 13 to separate lint cotton 15 from trash 17 in a cotton/trash mix 19 discharged by the cotton gin 13, and consists of a improvement of the type lint cotton cleaners disclosed in Van Doom, U.S. Pat. No. 2,681,476, issued Jun. 22, 1954, and Van Doom, U.S. Pat. No. 2,681,477, issued Jun. 22, 1954, both of which being incorporated herein by reference. The cotton gin 13 is illustrated in FIG. 1 as a standard gin stand for separating cotton seeds from cotton fibers. However, the cotton gin 13 may include a plurality of standard gin stands. In either event, after the cotton gin 13 separates cotton seeds from lint cotton 15, trash 17 will remain mixed with the lint cotton 15, resulting in the cotton/trash mix 19. The cotton/trash mix 19 is discharged from the cotton gin 13 through a cotton/trash mix discharge duct 21 (or a cotton/trash mix ductwork, not shown, joining a plurality of gin stands, etc.) in a stream of pressurized air, etc. Clean lint cotton 15 is discharged though a lint cotton discharge duct 23. An elbow (not shown) is typically located between the cotton/trash mix discharge duct 21 and the lint cotton discharge duct 23 as will be apparent to those skilled in the art. Lint cleaner pull fans (not shown) are commonly associated with the lint cotton discharge duct 23 to place several thousand cubic feet per minute (cfm) pressure on the lint cotton discharge duct 23. The apparatus 11 is designed to be installed in an existing gin system in the actual elbow duct line (e.g., to replace the typical elbow located between the cotton/trash mix discharge duct 21 and the lint cotton discharge duct 23) to receive the cotton/trash mix 19 from the discharge duct 21 and ultimately to discharge the clean lint cotton 15 though through lint cotton discharge duct 23.

The apparatus 11 includes a substantially hollow housing 25 and ductwork 27 formed within or as an integral part of the housing 25. The ductwork 27 may consist of an elbow and includes a cotton/trash mix inlet duct 29 having a cotton/trash mix inlet port 31 for receiving the cotton/trash mix 19 discharged by the cotton gin 13, includes a lint cotton outlet duct 33 having a lint cotton outlet port 35 for allowing lint cotton 15 to exit therethrough, and has a trash outlet port 37 positioned about center distance of the actual elbow, intermediate the inlet port 31 of the inlet duct 29 and the lint cotton outlet port 35 of the lint cotton outlet duct 33 for allowing trash 17 to exit therethrough.

The cotton/trash mix inlet duct 29 has an interior passageway 39 with at least a portion of the interior passageway 39 having a contour with a variable cross-sectional area. The lint cotton outlet duct 33 has an interior passageway 41 with at least a portion of the interior passageway 41 having a contour with a variable cross-sectional area.

The apparatus 11 includes a knife 43 movably mounted within the housing 25 and positioned at or within the trash outlet port 37. More specifically, the knife 43 preferably includes a body or blade portion 44 having a sharp edge 45 positioned at or within the trash outlet port 37 and extending substantially the entire length of the trash outlet port 35.

The apparatus 11 includes control means 47 for causing movement of at least a portion of the inlet duct 29 to vary the cross sectional area of the contour of at least a portion of the interior passageway 39 thereof and/or the size of the trash outlet port 37, and for causing movement of at least a portion of the lint cotton outlet duct 33 to vary the cross sectional area of at least a portion of the contour of the interior passageway 41 thereof and for causing movement of the knife 43 to vary the size of the trash outlet port 37. The control means 47 preferably includes a first mechanism 49 for causing movement of at least a portion of the inlet duct 29 to vary the cross sectional area of the contour of at least a portion of the interior passageway 39 thereof; a second mechanism 51 for causing movement of at least a portion of the inlet duct 29 to vary the size of the trash outlet port 37; and a third mechanism 53 for causing movement of at least a portion of the lint cotton outlet duct 33 to vary the cross sectional area of the contour of at least a portion of the interior passageway 41 thereof and for causing movement of the knife 43 to vary the size of the trash outlet port 37. The actual construction and operation of the first, second and third mechanisms 49, 51, 53 may vary as will now be apparent to those skilled in the art. Thus, for example, each first, second and third mechanism 49, 51, 53 may consist of a manually or electrically operated rack and pinion mechanism, etc.

The first mechanism 49 preferably includes a pinion 55 rotatably supported within the housing 25 and operatively coupled or geared to a rack 57 that is mounted on a body 59 that is slidably supported within the housing 25 in any manner now apparent to those skilled in the art and that is, in turn, operatively coupled to a moveable portion 60 of the inlet duct 29 (see FIGS. 2–5) so that rotation of the pinion 55 will cause the moveable portion 60 of the inlet duct 29 to move in a manner to vary the cross sectional area of the contour of at least a portion of the interior passageway 39. More specifically, as diagrammatically shown in FIG. 4, rotation of the pinion 55 will cause the rack 57 and the body 59 to move in the direction of the arrow 61 which will, in turn, cause the second mechanism 51 and the moveable portion 60 of the inlet duct 29 to move in the direction of the arrow 61 thereby varying the cross sectional area of the contour of at least a portion of the interior passageway 39 as will now be apparent to those skilled in the art. The pinion 55 may be rotated manually or electrically, etc. For example, in a manual system, the axle of the pinion 55 may extend through each end of the housing 25 and terminate in an arm or handle 62 (see FIG. 1) for being manually rotated to, in turn, rotate the pinion 55 and thereby cause the rack 57 and the body 59 to move in the direction of the arrow 61.

The second mechanism 51 preferably includes a pinion 63 rotatably mounted to the body 59 and operatively coupled or geared to a rack 57 that is mounted on the movable portion 60 of the inlet duct 29 (see FIGS. 2–5) so that rotation of the pinion 63 will cause the moveable portion 60 of the inlet duct 29 to move in a manner to vary the size of the trash outlet port 37. More specifically, as diagrammatically shown in FIG. 5, rotation of the pinion 63 will cause the rack 65 and the moveable portion 60 of the inlet duct 29 to move in the direction of the arrow 67 thereby varying the size of the trash outlet port 37 as will now be apparent to those skilled in the art. The pinion 63 may be rotated manually or electrically, etc. For example, in a manual system, the axle of the pinion 63 may extend through each end of the housing 25 and terminate in an arm or handle 68 (see FIG. 1) for being manually rotated to, in turn, rotate the pinion 63 and thereby cause the rack 65 and the moveable portion 60 of the inlet duct 29 to move in the direction of the arrow 67.

The third mechanism 53 preferably includes a pinion 69 rotatably supported within the housing 25 and operatively coupled or geared to a rack 71 that is mounted on the blade portion 44 of the knife 43 that is, in turn, mounted on a moveable portion 73 of the outlet duct 33 (see FIGS. 2–5) so that rotation of the pinion 69 will cause the knife 43 to move in a manner to vary the size of the trash outlet port 37, and will cause the moveable portion 73 of the outlet duct 33 to move in a manner to vary the cross sectional area of the contour of at least a portion of the interior passageway 41 and the size of the trash outlet port 37. More specifically, as diagrammatically shown in FIG. 3, rotation of the pinion 69 will cause the rack 71 and the knife 43 to move in the direction of the arrow 75 which will, in turn, cause the moveable portion 73 of the outlet duct 33 to move in the direction of the arrow 75 thereby varying the cross sectional area of the contour of at least a portion of the interior passageway 41 and the size of the trash outlet port 37 as will now be apparent to those skilled in the art. The pinion 69 may be rotated manually or electrically, etc. For example, in a manual system, the axle of the pinion 69 may extend through each end of the housing 25 and terminate in an arm or handle 76 (see FIG. 1) for being manually rotated to, in turn, rotate the pinion 69 and thereby cause the rack 71 and the knife 43 to move in the direction of the arrow 75.

The apparatus 11 preferably includes deflector means 77 attached to the knife 43 for deflecting trash 17 from the trash outlet port 37. The deflector means 77 preferably consists of a downturned ledge or rim on the end of the blade portion 44 of the knife 43 opposite the sharp edge 45 thereof to turn or divert the trash 17 downwardly.

The apparatus 11 preferably includes trash conveyor means 81 located below the trash outlet port 37 for conveying trash 17 that exits the trash outlet port 37 to a desired location.

The apparatus 11 may be constructed in various manners and out of various materials as will now be apparent to those skilled in the art. Thus, for example, the majority of the housing 25 including the ductwork 27 can be cut, bent, etc., out of sheet metal. The movable portion 60 of the inlet duct 29 may be created by forming the bottom of the throat of inlet duct 29 out of flexible metal that inherently allows the bottom of the throat thereof to be moved toward and away from the top of the throat thereof, and by constructing the inner and outer ends of the bottom of the throat of the inlet duct 29 as separate units so that the outer end thereof can slide in and out with respect to the inner end thereof, as will now be apparent to those skilled in the art. The movable portion 73 of the outlet duct 33 may be created by forming the rear side of the throat of outlet duct 33 out of flexible metal that inherently allows the rear side of the throat thereof to be moved toward and away from the front side of the throat of the outlet duct 33 as will now be apparent to those skilled in the art. The knife 43 and deflector means 77 can be made as a one-piece, integral unit out of a 3 inch by 3 inch by ¼ inch (7.62 centimeters by 7.62 centimeters by 0.635 centimeters) angle with a 30° surface cut for the sharp edge 45. The various pinions and racks can be off-the-shelf units having appropriate ratios, etc. The body 59 and various shafts and control arms, etc., for the control means 47 may be machined or otherwise constructed from metal or the like. The trash conveyor means 81 may consist of an endless conveyor belt, etc. Preferably, the trash conveyor means consist of a typical screw-type conveyor including standard 6 inch (15.24 centimeters) augers, etc., driven by an electric motor (not shown) or the like.

The apparatus 11 may be constructed in various sized to handle various quantities or flow rates of cotton/trash mix 19 as will now be apparent to those skilled in the art.

Although the present invention has been described and illustrated with respect to a preferred embodiment and a preferred use therefor, it is not to be so limited since modifications and changes can be made therein which are within the full intended scope of the invention.

What is claimed is:

1. An apparatus for use with a cotton gin to separate lint cotton from trash in a cotton/trash mix discharged by the cotton gin; the apparatus comprising:

(a) ductwork including an inlet duct having an inlet port for receiving the cotton/trash mix discharged by the cotton gin, including a lint cotton outlet duct having a lint cotton outlet port for allowing lint cotton to exit therethrough, and having a trash outlet port intermediate the inlet port of the inlet duct and the lint cotton outlet port of the lint cotton outlet duct for allowing trash to exit therethrough; the inlet duct having an interior passageway, at least a portion of the interior passageway of the inlet duct having a contour with a variable cross-sectional area; the lint cotton outlet duct having an interior passageway, at least a portion of the interior passageway of the lint cotton outlet duct having a contour with a variable cross-sectional area;

(b) a knife positioned at the trash outlet port; and (c) control means for causing movement of at least a portion of the inlet duct to vary the cross sectional area of the contour of at least a portion of the interior passageway thereof and the size of the trash outlet port, and for causing movement of at least a portion of the lint cotton outlet duct to vary the cross sectional area of the contour of at least a portion of the interior passageway thereof and for causing movement of the knife to vary the size of the trash outlet port; the control means including a first rack and pinion mechanism for causing movement of at least a portion of the inlet duct to vary the cross sectional area of the contour of at least a portion of the interior passageway thereof, a second rack and pinion mechanism for causing movement of at least a portion of the inlet duct to vary the size of the trash outlet port, and a third rack and pinion mechanism for causing movement of at least a portion of the lint cotton outlet duct to vary the cross sectional area of the contour of at least a portion of the interior passageway thereof and for causing movement of the knife to vary the size of the trash outlet port.

* * * * *